US008294091B2

(12) United States Patent
Jarrell

(10) Patent No.: US 8,294,091 B2
(45) Date of Patent: Oct. 23, 2012

(54) METHODS AND APPARATUS FOR PERFORMING GAS AND LIQUID MASS SPECTROMETRY

(75) Inventor: Joseph A. Jarrell, Newton Highlands, MA (US)

(73) Assignee: Waters Technologies Corporation, Milford, MA (US)

( * ) Notice: Subject to any disclaimer, the term of this patent is extended or adjusted under 35 U.S.C. 154(b) by 73 days.

(21) Appl. No.: 12/991,026

(22) PCT Filed: May 5, 2009

(86) PCT No.: PCT/US2009/042820

§ 371 (c)(1),
(2), (4) Date: Dec. 14, 2010

(87) PCT Pub. No.: WO2009/137463

PCT Pub. Date: Nov. 12, 2009

(65) Prior Publication Data

US 2011/0290994 A1 Dec. 1, 2011

Related U.S. Application Data

(60) Provisional application No. 61/051,095, filed on May 7, 2008.

(51) Int. Cl.
*H01J 49/10* (2006.01)

(52) U.S. Cl. ..... 250/288

(58) Field of Classification Search ..... 250/288, 250/423 R, 281, 282

See application file for complete search history.

(56) References Cited

U.S. PATENT DOCUMENTS

| | | | | |
|---|---|---|---|---|
| 7,417,226 | B2 | 8/2008 | Bajic et al. | |
| 7,642,510 | B2 * | 1/2010 | McEwen | 250/288 |
| 7,820,980 | B2 * | 10/2010 | Balogh | 250/424 |
| 7,977,629 | B2 * | 7/2011 | McEwen et al. | 250/288 |
| 2003/0020013 | A1 | 1/2003 | Sakairi | |
| 2003/0171697 | A1 | 9/2003 | Smith et al. | |
| 2007/0114439 | A1 | 5/2007 | Bajic et al. | |

OTHER PUBLICATIONS

McEwen, Charles N.; GC/MS on an LC/MS instrument using atmospheric pressure photoionization; International Journal of Mass Spectrometry 259 (2007) 57-64.

Horning, E. C., et al.; New Picogram Detection System Based on a Mass Spectrometer with an External Ionization Source at Atmospheric Pressure; Analytical Chemistry, vol. 45, No. 6, May 1973.

Luosujarvi, Laura, et al; Gas chromatography/mass spectrometry of polychlorinated biphenyls using atmospheric pressure chemical ionization and atmospheric pressure photoionization microchips; Rapid Communications in Mass Spectrometry 2008, 22: 425-431.

Dzidic, D. I. Carroll, et al.; Comparison of Positive Ions Formed in Nickel-63 and Corona Discharge Ion Sources Using Nitrogen, Argon, Isobutane, Ammonia and Nitric Oxide as Reagents in Atmospheric Pressure Ionization Mass Spectrometry; Analytical Chemistry, vol. 48, No. 12, Oct. 1976-1763.

* cited by examiner

*Primary Examiner* — Kiet T Nguyen

(57) ABSTRACT

Embodiments of the present invention feature devices and methods for performing gas chromatography and liquid chromatography with mass spectrometry. The device and method feature a removable housing which housing contains the gas samples when the mass spectrometry receives gas samples. The device fits an atmospheric pressure ionization housing and upon removal, the atmospheric pressure ionization housing receives liquid samples.

12 Claims, 2 Drawing Sheets

METHODS AND APPARATUS FOR PERFORMING GAS AND LIQUID MASS SPECTROMETRY

CROSS-REFERENCE TO RELATED APPLICATIONS

This application is a 371 of PCT/US2009/042820, filed May 5, 2009 and designating the United States, which claims benefit of a priority U.S. Provisional Patent Application No. 61/051,095, filed May 7, 2008.

STATEMENT REGARDING FEDERALLY SPONSORED RESEARCH OR DEVELOPMENT

None.

THE NAMES OF THE PARTIES TO A JOINT RESEARCH AGREEMENT

None.

REFERENCE TO SEQUENCE LISTING

None.

FIELD OF THE INVENTION

This invention relates to the field of mass spectrometry.

BACKGROUND

To facilitate an understanding of the present invention the following terms will be used with the meanings set forth in the text that follows.

As used herein the term "mass spectrometry" refers to analytical techniques that measure the mass to charge ratio of ions. For the purpose of this discussion, unless otherwise indicated, the term includes time of flight, sector quadrupole, ion trap, Fourier transform ion cyclotron resonance, and tandem mass spectrometers.

Mass spectrometers receiving liquid samples, for example, mass spectrometers coupled to liquid chromatographic systems, have commonly used a device known as atmospheric pressure ionization to atomize liquid samples and place charges on the droplets and molecules. One normally does not wish to know the mass to charge ratio of droplets but rather one or more molecules contained in the droplets. As used herein, molecules for which information regarding mass to charge ratios is desired are referred to as analytes. Atmospheric pressure ionization may comprise the steps of electrospray, atmospheric pressure chemical ionization, or photoionization.

Droplets are desolvated to leave analyte molecules and other molecules carried in the sample. As the droplets are desolvated, molecules with charges, ions, remain. These ions enter a small opening often having a cone-like covering, into vacuum regions of the instrument. The atmospheric pressure ionization device is normally contained in an atmospheric pressure ionization housing at or near atmospheric pressure and prevents the sample from being discharged into the laboratory in which the mass spectrometer is placed.

The atmospheric pressure ionization housing is typically equipped with ports for introducing inert gases to facilitate solvent removal. Atmospheric pressure ionization housings are often equipped with a corona discharge pin for effecting atmospheric pressure chemical ionization. A corona discharge pin or needle is used to discharge electrons which electrons may cause molecules and droplets to form charged droplets and ions. Commonly, but not exclusively these electrons ionize reagent gases of solvent vapors, which ions then transfer their charge to analyte molecules.

As used herein, the term "vacuum regions" refers to those internal chambers of the mass spectrometer which are maintained at pressures below atmospheric pressure.

As used herein, the term "chromatography" refers to methods of separating compounds from each other by the different affinity such compounds will exhibit to different materials or phases. Gas chromatography refers to chromatographic separations in which the analyte is in a solution of gas. Gas chromatography mass spectrometry refers to the use of the outflow of a gas chromatographic system as the inlet source of a mass spectrometer. Gas chromatographic systems interfaces with mass spectrometers do not usually need to desolvate the sample because the sample is a gas, not a liquid. The gas chromatographic system can place the end of the column in substantially direct fluid communication with a source of electrons and the inlet of the mass spectrometer.

Liquid chromatography mass spectrometry refers to the use of a liquid chromatographic system coupled to a mass spectrometer. Liquid chromatographic systems are typically coupled to a mass spectrometer by means of an atmospheric pressure ionization and atmospheric pressure ionization housing. The atmospheric pressure ionization housing are sized and shaped to effect desolvation and commonly receive a liquid sample.

Gas samples received in an atmospheric pressure ionization housing are overly diluted and do not respond well to changes in sample composition. The separation effected by gas chromatographic processes are lost or lose definition.

However, due to the large capital cost of mass spectrometers, it is desirable to have the mass spectrometer capable of receiving and processing a broad range of samples, both liquid and gas samples, in a manner that is accurate and reproducible.

SUMMARY OF THE INVENTION

Embodiments of the present invention are directed to devices and methods for performing mass spectrometry in which a broad range of samples, both liquid and gas samples, are analyzed in a manner that is accurate and reproducible. One embodiment of the present invention directed to a device for placing one or more analyte molecules in a vacuum region of a mass spectrometer, has a major element comprising a housing. The housing has at least one wall, in which the wall defines a chamber. The chamber has at least one outlet port, at least one gas inlet, at least a sample port, and at least one corona pin port. The sample port is constructed and arranged to receive a gas chromatographic column. The gas chromatographic column is for placing the analyte molecules in the chamber. The gas inlet is constructed and arranged to be placed in fluid communication with a source of an inert gas for placing the inert gas into the chamber. The outlet port constructed and arranged to be received on or about an opening of a vacuum region of a mass spectrometer within an atmospheric pressure region of an atmospheric pressure ionization housing to form a substantially closed vessel comprising the at least one wall and in fluid communication with the vacuum region. The chamber has a volume of 0.5 to 5.0 cc when the outlet port is received on or about the opening of the vacuum region. The at least one corona pin port is constructed and arranged for receiving a corona discharge pin for discharging electrons. The discharged electrons place a charge on analyte molecules as the analyte molecules leave the gas chromatographic column. These charged and uncharged analyte molecules are circulated around said chamber by the gas introduced through the gas inlet and received in the opening of the vacuum region for mass analysis.

Without being bound to any particular theory of operation, it is believed that the limited volume of the chamber allows the mass spectrometer equipped with the device to be more responsive to changes is the compositions from the gas chromatography system.

Preferably, the device has a housing received on or over, the inlet cone of a mass spectrometer. For example, the outlet port of the chamber is substantially occupied by the inlet cone of the mass spectrometer. Inlet cones of mass spectrometers generally have circular bases. A preferred chamber is cylindrical to correspond with a circular base.

The opening of the vacuum region defines a sample axis. A preferred sample port is constructed and arranged to introduce analyte molecules within sixty degrees of a line perpendicular to said sample axis. A preferred device has a gas chromatographic column.

Preferably, the corona discharge port is constructed and arranged to place the corona discharge pin within the flow of the sample discharged from the gas chromatographic column. For example, without limitation, a preferred position for the corona discharge port is aligned with the sample axis. The gas sample circulates around the corona discharge pin. Preferably, the device comprises the corona discharge pin.

Preferably, the device is releasably received about said opening of said vacuum region of said mass spectrometer. For example, the device is secured by cooperating threads, on the cone or a threaded ridge or depression, of screws and nuts received in cooperating holes, locking cams, cooperating sliding fit, pins and the like. The removal of the device allows mass spectrometer to receive liquid samples from an atmospheric pressure ionization source. And, upon securing the device to the opening of the vacuum regions of the mass spectrometer, the mass spectrometer receives gas chromatographic samples with high levels of performance.

A further embodiment of the present invention features a method of performing mass spectrometry. The method comprises the steps of providing a atmospheric pressure atmospheric pressure ionization mass spectrometer having a atmospheric pressure ionization housing and an opening to the vacuum region of the mass spectrometer. The method further provides the step of affixing a housing having at least one wall to the opening of the vacuum regions of the mass spectrometer. The wall defines a chamber and has at least one outlet port, at least one gas inlet, at least a sample port, and at least one corona pin port. The sample port is constructed and arranged to receive a gas chromatographic column. The gas chromatographic column is for placing the analyte molecules in the chamber. The gas inlet is constructed and arranged to be placed in fluid communication with a source of an inert gas for placing an inert gas into the chamber. The outlet port is constructed and arranged to be received on or about an opening of a vacuum region of a mass spectrometer within an atmospheric pressure region of an atmospheric pressure ionization housing. Thus, the chamber forms a substantially closed vessel in fluid communication with the vacuum region. The chamber has a volume of 0.5 to 5.0 cc when the outlet port is received on or about said opening of said vacuum region. At least one corona pin port is constructed and arranged for receiving a corona discharge pin for discharging electrons and placing a charge on analyte molecules. The analyte molecules receive the charge as the analyte molecules leave the gas chromatographic column, are circulated around the chamber by the gas introduced through the gas inlet and received in the opening of said vacuum region for mass analysis. And, the method comprises the steps of performing gas chromatography with a column fitted to the sample port, ionizing at least one analyte molecule to form an analyte ion with a corona discharge pin placed in the corona pin port and directing the analyte ion into the opening of the vacuum region of the mass spectrometer to perform gas chromatography mass spectrometry.

Preferably, the method further comprises the step of removing the housing and operating the mass spectrometer as an atmospheric pressure ionization of liquid samples.

These and other features and advantages of the present invention will be apparent to those skilled in the art upon reading the following detailed descriptions and viewing the drawing.

DETAILED DESCRIPTION OF THE INVENTION

Embodiments of the present invention will be described in detail as devices and methods for performing mass spectrometry in which a broad range of samples, both liquid and gas samples, are analyzed. The following description is directed to preferred embodiments which those skilled in the art will recognize are capable of alteration and modification.

Figure 3:
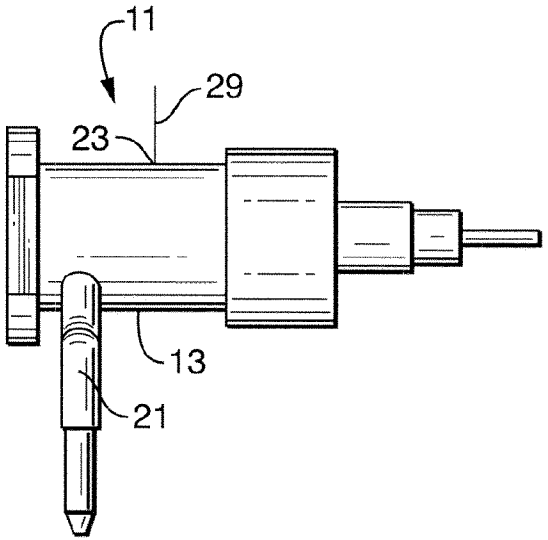
FIG. 3 depicts a side view of FIG. 1.
Figure 1:
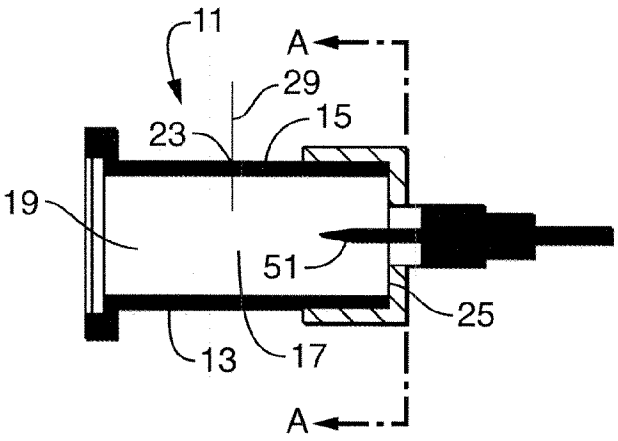
FIG. 1 depicts in cross section a device embodying features of the present invention.
Figure 2:
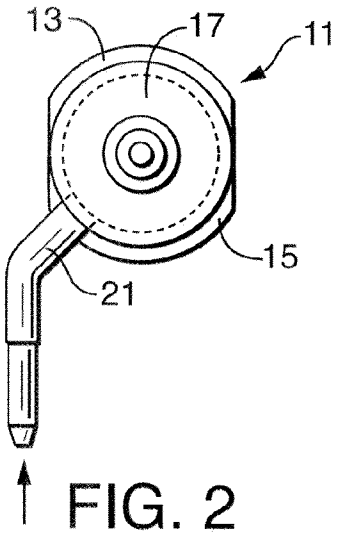
FIG. 2 depicts a view along line A-A of the device of FIG. 1.

An embodiment of the present invention, directed to a device for placing one or more analyte molecules in a vacuum region of a mass spectrometer, generally designated by the numeral 11 is depicted in FIGS. 1, 2 and 3. The device has a housing 13. As best seen in FIG. 1, the housing has at least one wall 15 which defines a chamber 17. The chamber 17 has at least one outlet port 19, at least one gas inlet 21 (best seen in FIGS. 2 and 3), at least a sample port 23, and at least one corona pin port 25.

The housing 13 is made of a structural material such as plastic, metal, glass or ceramic. A preferred metal is stainless steel, titanium, aluminum, copper, brass and other alloys.

The sample port 19 is constructed and arranged to receive a gas chromatographic column 29. The gas chromatographic column 29 is for placing the analyte molecules in the chamber 17. The analyte molecules are suspended or dissolved in gas. Gas chromatographic columns 29 are known in the art and are available from several venders. For example, without limitation, gas chromatographic columns are sold by Varian, Inc. (Palo Alto, Calif., USA) under several trademarks including FactorFour™, CP-Sil, and Select™. The sample port 19 is positioned with respect to the corona pin port 25 so as to allow the gases exiting the gas chromatographic column 29 to be ionized. The respective position of the sample port 19 and corona pin port 15 can readily be reversed.

Sample port 23 receives the gas chromatographic column 29 such that the column 29 projects into the chamber 17. The outside wall of the column 29 and the inner diameter of the sample port cooperate to form a close fit. However, the fit need not be airtight. A gap allows excess gas in chamber 17 to vent and be carried off by the vent structure of the atmospheric pressure ionization housing in which the device 11 is placed. However, if desired, the column 29 can be fitted in a more tight arrangement to the wall 15 of housing 13 with fittings [not shown] known in the art.

Gas inlet 21, best seen in FIGS. 2 and 3, is constructed and arranged to be placed in fluid communication with a source of an inert gas [not shown] for placing the inert gas into the chamber 17. Inert gases comprise any substantially non-reactive gas, such as nitrogen. Such gases are sold by numerous venders under pressure in tanks.

Figure 4:
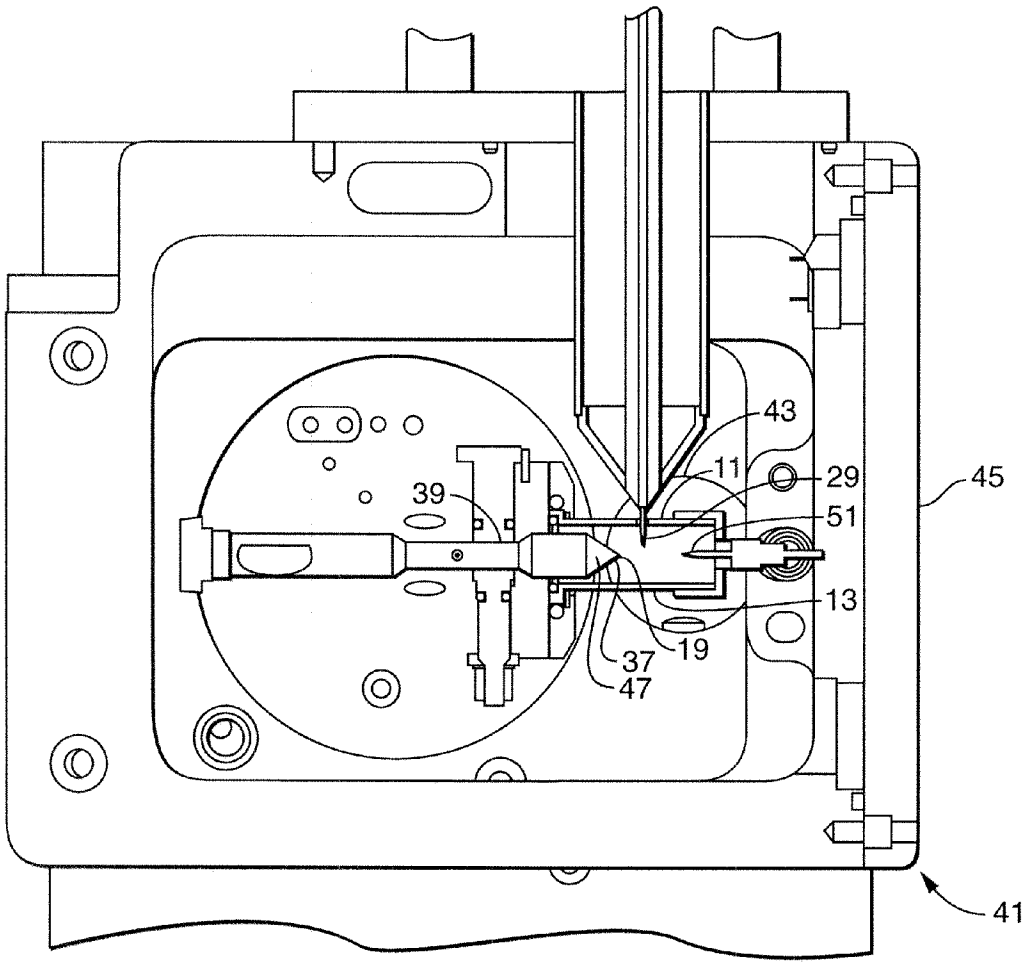
FIG. 4 depicts a device embodying features of the present invention in the atmospheric pressure of an atmospheric pressure ionization mass spectrometer.

Turning now to FIGS. 1 and 4, outlet port 19 is constructed and arranged to be received on or about an opening 37 of a vacuum region 39 of a mass spectrometer generally designated by the numeral 41. The opening 37 normally interfaces between the vacuum region 39 and an atmospheric pressure region 43 of an atmospheric pressure ionization housing 45. The atmospheric region 43 may deviate slightly from atmospheric but is substantially near or slightly above or below atmospheric pressure.

Opening 37 is in an inlet cone 47 to which the device 11 is releasably affixed. The inlet cone 47 substantially fills the outlet port 19 to form a substantially closed chamber 17 comprising the at least one wall 15. The chamber 17 has a volume of 0.5 to 5.0 cc when the outlet port 19 is received on or about the opening 37 of the vacuum region 39.

The device 11 is releasably affixed by a close fit of wall 15 and the cone 47. However, those skilled in the art will recognize that the device 11 can be affixed on or about the opening 37 of the high pressure region 39 by any number of means including screws, cooperating threads, pins, inter-fitting rims, clips, clamps, releasable glues and the like.

In the event the cone 47 is releasably affixed to the mass spectrometer 45, the cone 47 can be incorporated in the device 11 as a further element. Thus, the outlet port 19 would correspond to the opening 37. The device 11 would be exchanged with a separate and distinct cone 47.

As depicted, the inlet cone 47 has a circular base which projects outward from a wall of the mass spectrometer. Thus, a preferred chamber 17 is cylindrical to correspond with a circular base of the inlet cone 47. However, other cross sectional shapes may also be used.

As best seen in FIG. 4, the opening 37 of the vacuum region 39 defines a sample axis shown along line B-B. A preferred sample port 19 is constructed and arranged to introduce analyte molecules within sixty degrees of a line perpendicular to the sample axis.

At least one corona pin port 25 is constructed and arranged for receiving a corona discharge pin 51 for discharging electrons. The discharged electrons place a charge on analyte molecules as the analyte molecules leave the gas chromatographic column 29. These charged and uncharged analyte molecules are circulated around the chamber 17 by the gas introduced through the gas inlet 21 and received in the opening 37 of the vacuum region for mass analysis.

Preferably, the corona discharge port 25 is constructed and arranged to place the corona discharge pin 51 within the flow of the sample discharged from the gas chromatographic column 29. As depicted, the corona discharge port 25 is aligned with the sample axis allowing gases to circulate around the corona discharge pin 51.

The removal of the device 11 allows mass spectrometer to receive liquid samples from an atmospheric pressure ionization source [not shown] in a conventional manner. The device is constructed and arranged to be received in the atmospheric pressure ionization housing 45 of a mass spectrometer 41. And, in the event gas samples are to be evaluated and analyzed, the device 11 is secured to the opening 37 of the vacuum regions of the mass spectrometer 41. The mass spectrometer 41 then receives gas chromatographic samples with high levels of performance.

A further embodiment of the present invention directed to a method of performing mass spectrometry will be described with respect to the operation of the device 11. The method comprises the steps of providing an atmospheric pressure atmospheric pressure ionization mass spectrometer 41 having an atmospheric pressure ionization housing 45 and an opening 37 the vacuum region 39. The method further provides the step of affixing a housing 13 having at least one wall 15 to the opening 37 of the vacuum regions 39 of the mass spectrometer 41. The wall 15 defines a chamber 17 and has at least one outlet port 19, at least one gas inlet 21, at least a sample port 23, and at least one corona pin port 25. The sample port 23 is constructed and arranged to receive a gas chromatographic column 29. The gas chromatographic column 29 is for placing the analyte molecules in the chamber 17. The gas inlet 21 is constructed and arranged to be placed in fluid communication with a source of an inert gas [not shown] for placing an inert gas into the chamber 17. The outlet port 19 is constructed and arranged to be received on or about an opening 37 of a vacuum region 39 of a mass spectrometer 41 within an atmospheric pressure region 43 of an atmospheric pressure ionization housing 45. Thus, the chamber 17 forms a substantially closed vessel in fluid communication with the vacuum region 39. The chamber 17 has a volume of 0.5 to 5.0 cc when the outlet port 19 is received on or about the opening 37 of the vacuum region 39. At least one corona pin port 25 is constructed and arranged for receiving a corona discharge pin 51 for discharging electrons and placing a charge on analyte molecules. The analyte molecules receive the charge as the analyte molecules leave the gas chromatographic column 29, are circulated around the chamber 17 by the gas introduced through the gas inlet 21 and received in the opening 37 of said vacuum region 39 for mass analysis. And, the method comprises the steps of performing gas chromatography with a column 29 fitted to the sample port 23, ionizing at least one analyte molecule to form an analyte ion with a corona discharge pin 51 placed in the corona pin port 25 and directing the analyte ion into the opening 37 of the vacuum region 39 of the mass spectrometer 41 to perform gas chromatography mass spectrometry.

Further embodiments of the method comprise the step of removing the housing 11 and operating the mass spectrometer 41 as an atmospheric pressure ionization on liquid samples.

Thus, the preferred embodiments of the present invention have been described with the understanding that those skilled in the art are capable of modifying and altering the invention described in detail herein without departing from the teaching. Thus, the invention should not be limited to the precise details presented, but should encompass the subject matter of the claims that follow and their equivalents.

The invention claimed is:

1. A device for placing one or more analyte molecules in a vacuum region of a mass spectrometer comprising:

a housing having at least one wall, said wall defining a chamber and having at least one outlet port, at least one gas inlet, at least a sample port, and at least one corona pin port, said sample port constructed and arranged to receive a gas chromatographic column, said gas chromatographic column for placing said analyte molecules in said chamber, said gas inlet constructed and arranged to be placed in fluid communication with a source of an inert gas for placing said inert gas into said chamber; said outlet port constructed and arranged to be received on or about an opening of a vacuum region of a mass spectrometer within an atmospheric pressure region of an atmospheric pressure ionization housing to form a substantially closed vessel comprising said at least one wall and in fluid communication with the vacuum region, said chamber having a volume of 0.5 to 5.0 cc when said outlet port is received on or about said opening of said vacuum region, said at least one corona pin port constructed and arranged for receiving a corona discharge pin for discharging electrons and placing a charge on analyte molecules; said analyte molecules receiving said charge as said analyte molecules leave said gas chromatographic column, are circulated around said chamber by said gas introduced in said gas inlet and received in said opening of said vacuum region for mass analysis.

2. The device of claim 1 wherein said housing is received on the inlet cone of a mass spectrometer.

3. The device of claim 1 wherein said chamber is cylindrical.

4. The device of claim 3 wherein said opening of said vacuum region defines a sample axis, and said sample port is constructed and arranged to introduce analyte molecules within sixty degrees of a line perpendicular to said sample axis.

5. The device of claim 4 further comprising a gas chromatographic column.

6. The device of claim 4 wherein said corona discharge port is constructed and arranged to place said corona discharge pin within the flow of said sample discharged from said gas chromatographic column.

7. The device of claim 6 wherein said corona discharge port is aligned with said sample axis.

8. The device of claim 7 further comprising a corona discharge pin.

9. The device of claim 1 wherein said housing is releasably received about said opening of said vacuum region of said mass spectrometer to allow mass spectrometer to receive liquid samples from an atmospheric pressure ionization source.

10. The device of claim 1 wherein said housing is received in an atmospheric pressure ionization housing of a mass spectrometer to allow said mass spectrometer to receive liquid samples formed by atmospheric pressure ionization in the absence of said housing and gas chromatographic samples upon affixing said housing to said opening of the vacuum region of said mass spectrometer.

11. A method of performing mass spectrometry comprising the steps of providing an atmospheric pressure ionization mass spectrometer having an atmospheric pressure ionization housing and an opening to a vacuum region of the mass spectrometer, affixing a housing having at least one wall, said wall defining a chamber and having at least one outlet port, at least one gas inlet, at least a sample port, and at least one corona pin port, said sample port constructed and arranged to receive a gas chromatographic column, said gas chromatographic column for placing said analyte molecules in said chamber, said gas inlet constructed and arranged to be placed in fluid communication with a source of an inert gas for placing said inert gas into said chamber; said outlet port constructed and arranged to be received on or about an opening of a vacuum region of a mass spectrometer within an atmospheric pressure region of an atmospheric pressure ionization housing to form a substantially closed vessel comprising said at least one wall and in fluid communication with the vacuum region, said chamber having a volume of 0.5 to 5.0 cc when said outlet port is received on or about said opening of said vacuum region, said at least one corona pin port constructed and arranged for receiving a corona discharge pin for discharging electrons and placing a charge on analyte molecules; said analyte molecules receiving said charge as said analyte molecules leave said gas chromatographic column, are circulated around said chamber by said gas introduced in said gas inlet and received in said opening of said vacuum region for mass analysis; and performing gas chromatography with a column fitted to said sample port, ionizing at least one analyte molecule to form an analyte ion with a corona discharge pin placed in said corona pin port and directing said analyte ion into said opening of said vacuum region of said mass spectrometer to perform gas chromatography mass spectrometry.

12. The method of claim 11 wherein said housing is removed and said atmospheric pressure ionization mass spectrometer is operated in liquid atmospheric pressure ionization mode to perform mass spectrometry on liquid samples.

* * * * *